US006260944B1

(12) United States Patent
Mochizuki et al.

(10) Patent No.: US 6,260,944 B1
(45) Date of Patent: Jul. 17, 2001

(54) INK JET TYPE RECORDING APPARATUS AND RECORDING HEAD CLEANING METHOD

(75) Inventors: Seiji Mochizuki; Satoshi Shinada; Hitoshi Hayakawa, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/815,602

(22) Filed: Mar. 12, 1997

Related U.S. Application Data

(63) Continuation of application No. 08/338,828, filed on Nov. 10, 1994, now abandoned, which is a continuation of application No. 07/883,278, filed on May 14, 1992, now abandoned.

(30) Foreign Application Priority Data

May 15, 1991 (JP) ..... 3-110225
Jun. 24, 1991 (JP) ..... 3-151618

(51) Int. Cl.[7] ..... B41J 2/165
(52) U.S. Cl. ..... 347/33
(58) Field of Search ..... 347/33, 32, 23

(56) References Cited

U.S. PATENT DOCUMENTS 4,144,537 * 3/1979 Kimura et al. ..... 347/31
4,745,414 * 5/1988 Okamura et al. ..... 347/33
4,927,277 * 5/1990 Niikawa ..... 400/56
4,947,190 * 8/1990 Mizusawa et al. ..... 347/33
4,951,066 * 8/1990 Terasawa et al. ..... 347/33
5,051,758 * 9/1991 Markham ..... 346/140
5,103,244 * 4/1992 Gast et al. ..... 346/1.1
5,153,614 * 10/1992 Yamaguchi et al. ..... 346/140
5,184,147 * 2/1993 MacLane et al. ..... 347/33
5,434,605 * 7/1995 Osborne ..... 347/23

FOREIGN PATENT DOCUMENTS

314513 * 5/1989 (EP) ..... 347/33
0323261 7/1989 (EP) .
0395004 10/1990 (EP) .
0101461 * 8/1980 (JP) ..... 346/140
57-95471 6/1982 (JP) .
61-5647 * 1/1986 (JP) .
2-95862 4/1990 (JP) .
32848 * 2/1991 (JP) ..... 347/33
3-99857 4/1991 (JP) .
99857 * 4/1991 (JP) ..... 347/33
3-258553 11/1991 (JP) .
4-141437 5/1992 (JP) .
4-232754 8/1992 (JP) .
4-307256 10/1992 (JP) .

* cited by examiner

*Primary Examiner*—John Barlow
*Assistant Examiner*—Craig A. Hallacher
(74) *Attorney, Agent, or Firm*—Sughrue, Mion, Zinn, Macpeak & Seas, PLLC

(57) ABSTRACT

An ink jet type recording apparatus comprises a recording head of ink jet type for jetting ink droplets from a nozzle to form a dot pattern on a recording medium and a cleaning unit which is moved in and out of the path of movement of the recording head when required, and made up of a spatula-shaped elastic blade member and a water-absorbing rubbing member bonded to the member. In the case where the nozzle surface of the recording head is to be cleaned with the rubbing member, the cleaning operation is carried out with the rubbing member wetted with ink. In cleaning the nozzle surface with the blade member, the latter is abutted against the recording head as it is.

7 Claims, 13 Drawing Sheets

INK JET TYPE RECORDING APPARATUS AND RECORDING HEAD CLEANING METHOD

This is a Continuation of application Ser. No. 08/338,828 filed Nov. 10, 1994 abandoned, which is a continuation of application Ser. No. 07/883,278 filed May 14, 1992, now abandoned.

BACKGROUND OF THE INVENTION

1. Field of the Invention

This invention relates to ink jet type recording apparatuses with nozzles for jetting ink droplets, and more particularly to an ink jet type recording apparatus with cleaning means for removing solidified ink, dust, fibers, etc. from the nozzle surface of the recording head.

2. Description of the Prior Art

In an ink jet type recording apparatus, a small quantity of ink is jetted, in the form of droplets, from the nozzles of the recording head by the energy produced by a piezo-electric oscillator or heat generating element, thus forming characters, patterns, etc. on a recording medium. The energy produced by the piezo-electric element or heat generating element to fly ink droplets is low, and therefore the gap between the nozzle surface and the recording medium is extremely small, not more than several millimeters. Hence, when colliding with the recording medium, the ink droplets are splashed back towards the recording head, thus sticking onto the nozzle surface. The ink droplets thus stuck attract fibers coming out of the recording medium and dust in the surrounding air to cause them to stick to the nozzle surface. The fibers and dust thus stuck may clog up the nozzle openings.

The recording head of ink jet type has a number of nozzles extremely small in diameter. Those nozzles are liable to be clogged up as was described above, and in addition they may be clogged up by the solvent of the ink itself. In order to overcome this difficulty, in general the ink jet type recording apparatus has a capping member for hermetically sealing the nozzles, and an ink discharge restoring function of applying negative pressure to the capping member to forcibly discharge ink from the nozzles. However, this ink discharge restoring operation suffers from a difficulty that ink discharged from the nozzles is splashed on the nozzle surface, so that, similarly as in the case where ink is splashed during printing, fibers coming out of the recording medium or dust in the air may stick to the nozzle surface.

In order to clean the nozzle surface which has been contaminated by ink splashed in various manners as was described above, the ink jet type recording apparatus has means for cleaning the nozzle surface.

For instance, Japanese Utility Patent Application (OPI) No. 5647/1986 (the term "OPI" as used herein means an "unexamined published application") has disclosed an ink jet type recording apparatus having a cleaning unit which comprises: a first cleaning member made of a porous plate such as a sponge; and a second cleaning member made of a rubber plate. The first and second cleaning members are arranged in such a manner that the front end portions of them are free with the rear end portions fixed, and the free front end portions are held protruded into the path of movement of the recording head.

With the apparatus, whenever the recording head is moved in one direction, the first cleaning member (porous plate) wetted with a solution rubs the nozzle surface of the recording head; and whenever the recording head is moved in the opposite direction, the second cleaning member scrapes the solution off the nozzle surface. Thus, the nozzle surface is maintained substantially clean at all times.

The size of those cleaning members is selected in compliance with the size of the nozzle surface of the ink jet type recording head; that is, it is considerably small. Hence, it is considerably difficult for them to have an elastic strength enough to provide a contact pressure required for cleaning the nozzle surface. That is, the above-described cleaning unit suffers from difficulties that, since the first and second cleaning members are fixed only at the rear ends, they are low in elasticity, and the solidified ink or fibers removed by the cleaning operation are liable to enter the gap between the first and second cleaning members.

U.S. Pat. No. 4,951,066 has disclosed a cleaning unit comprising a blade member of rubber, and a rubbing member made of a porous sheet which are both arranged outside of the printing region. The cleaning unit is advantageous in that those members are positively brought into elastic contact with the nozzle surface, so that the contaminants are positively wiped off and the solution is also positively scraped off; however, it is still disadvantageous in that it is rather intricate in construction because it needs means for driving the first and second cleaning mars.

SUMMARY OF THE INVENTION

Accordingly, a first object of this invention is to provide an ink jet type recording apparatus provided with a cleaning unit which is simple in construction and can be miniaturized, and which is able to positively remove contaminants from the recording head.

A second object of the invention is to provide an ink jet type recording apparatus provided with a cleaning unit which is able to effectively prevent the recontamination of the recording head.

The foregoing objects and other objects of the Invention have been achieved by the provision of an ink jet type recording apparatus comprising; a recording head of ink jet type for jetting ink droplets from nozzles to form a dot pattern on a recording medium; cleaning means which is moved in and out of the path of movement of the recording head when required; and drive means for moving the cleaning means to a position where the cleaning means is brought into contact with the nozzle surface of the recording head and to a position where the cleaning means is not in contact therewith; in which according to the invention, the cleaning means comprises: a spatula-shaped elastic blade member; and a water-absorbing rubbing member bonded to the blade member, and one of the edges of the blade member and the rubbing member is selectively brought into contact with the nozzle surface of the recording head with the aid of the elasticity of the blade member.

DETAILED DESCRIPTION OF THE PREFERRED EMBODIMENTS

Preferred embodiments of this invention will be described with reference to the accompanying drawings.

Figure 1:
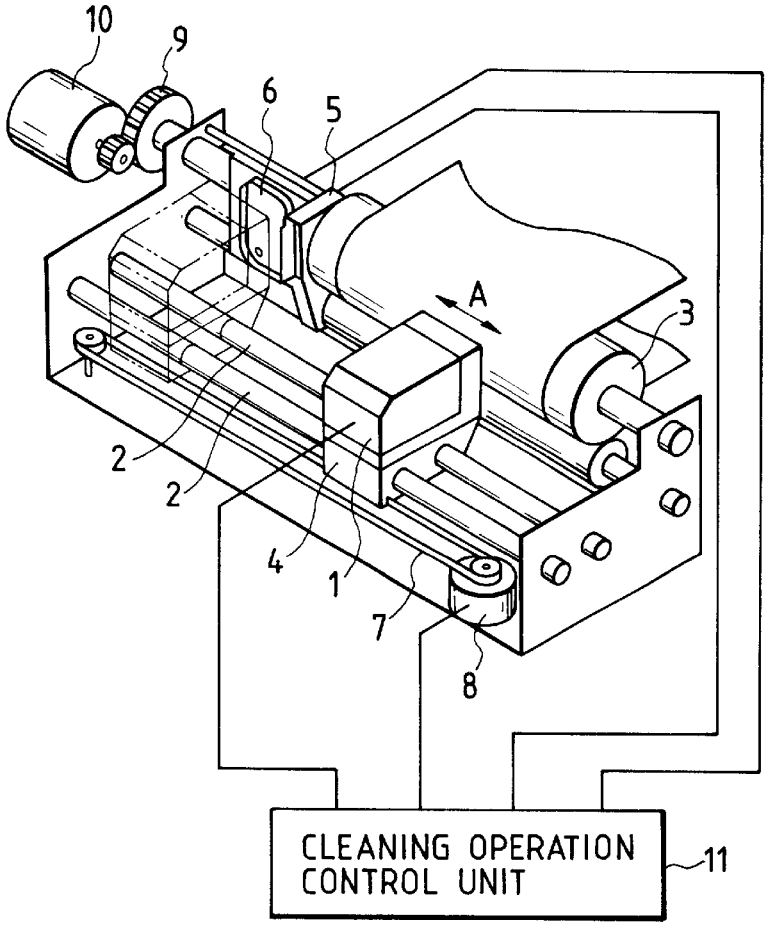
FIG. 1 is a view showing a structure of an ink jet type recording apparatus with a cleaning unit according to one embodiment of the present invention.

An ink jet type recording apparatus with a cleaning unit according to the invention, as shown in FIG. 1, comprises: an ink jet type recording head 1 mounted on a carriage 4 which is reciprocated on guide members 2 along the axis of a platen 3 so that the head is moved to the printing region, and to a cleaning unit 5 and a capping unit 6 arranged outside the printing region. The carriage 4 is coupled through a timing belt 7 to a carriage driving electric motor 8. The platen 3 is coupled through a train of gears to a platen driving electric motor 10.

When at rest, the recording head 1 is positioned as indicated by the dotted lines, where it is capped by the capping unit 6, so that the ink is prevented from being dried. Furthermore, when necessary, the nozzle surface of the recording head is cleaned by the cleaning unit 5.

Further in FIG. 1, reference numeral 11 designates a cleaning operation control unit for controlling the operations of the recording head 1, the cleaning unit 5, the capping unit 6, and the carriage driving motor 8 to perform a cleaning operation.

Figure 2:
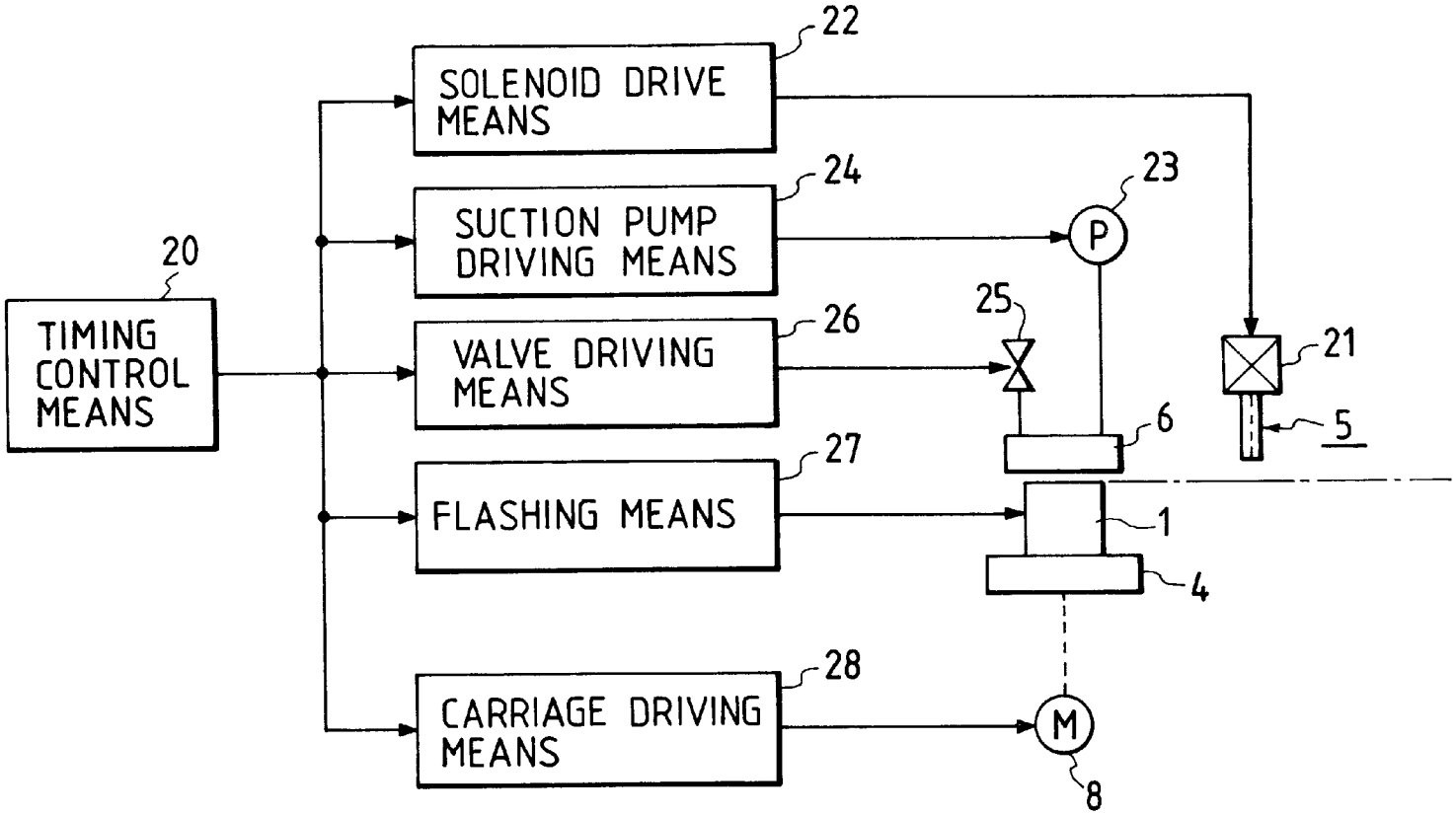
FIG. 2 is a block diagram showing a cleaning operation control unit used in the ink jot type recording apparatus of FIG. 1.

The cleaning operation control unit 11, as shown in FIG. 2, comprises: timing control means 20 for detecting the movement of the carriage, to determine operations for members concerning the cleaning operation; solenoid drive means 22 for activating drive means 21 provided for the cleaning unit 5 in response to a timing signal; suction pump driving means 24 for controlling the operation of a suction pump 23 connected to the capping unit 6; valve driving means 26 for operating (opening or closing) an air valve 25 connected to the capping unit 6; flushing means 27 for discharging ink from the recording head 1 in an ink discharge restoring operation; and carriage driving means 28 for moving the recording head 1 to the capping unit and to the cleaning unit 5 to clean it.

Figure 3:
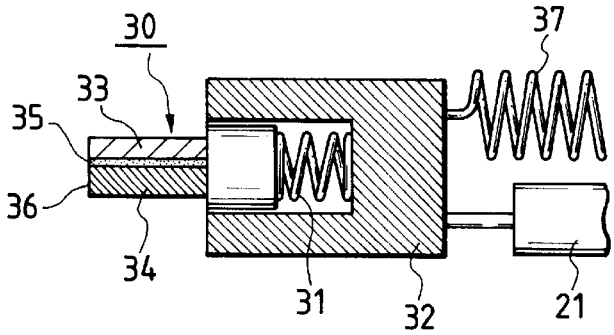
FIG. 3 is a sectional view showing a cleaning unit used in the ink jet type recording apparatus of FIG. 1.

FIG. 3 shows the cleaning unit 5 in detail. In FIG. 3, reference numeral 30 designates a cleaning element, the rear end portion of which is coupled through a compression spring 31 to a frame 32. The cleaning element 30 is formed by bonding a blade member 33 and a rubbing member 34 together with an elastic adhesive of rubber or silicon series in such a manner that the front end faces of them are flush with each other. The blade member 33 is formed by molding a material such as silicon rubber or butyl rubber relatively high in elasticity, being substantially in the form of a spatula. The rubbing member 34 is made of unwoven cloth high both in hygroscopicity and in wear resistance; however, it goes without saying that it may be formed using a foamed material.

In a cleaning operation with the blade member 33, the latter 33 is pushed against the nozzle surface of the recording head at a pressure of the order of 10 to 50 g., to remove a liquid such as ink from the nozzle surface. On the other hand, the rubbing member 34 is used to remove an extremely sticky material. Therefore, in a cleaning operation with the rubbing member 34, a relative high pressure, about 50 to 150 g., is employed.

In the case where the blade member 33 is a rubber plate 1.0 mm in thickness, 8 mm in length, 15 mm in width, and 40° in hardness while the rubbing member 34 is a piece of unwoven cloth 1.3 mm in thickness, 8 mm in length, and 15 mm in width, a pressure of the order of 40 g. is applied to the nozzle surface when the latter is wiped with the blade member 33, and a pressure of the order of 130 g. when rubbed with the rubbing member 34. The unwoven cloth itself is not stiff, and cannot provide a pressure as high as 130 g. However, the rubbing member 34 of unwoven cloth, being supported by the blade member 33 of silicon rubber from behind, can provide a pressure high enough to rub the nozzle surface.

The frame 32 is secured to the base of the recording apparatus body through a tension spring 37 and an electromagnetic plunger 21 in such a manner that the end face 36 confronts with the nozzle surface of the recording head 1. The tension spring 37 is so energized that the end face 36 of the rubbing member 34 is retracted from the path of movement of the recording head 1. The electromagnetic plunger 21 is so designed that, when energized, it causes the end face of the cleaning element 30 to go across the path along which the nozzle surface of the recording head 1 is moved.

A first cleaning operation with the unit thus constructed will be described.

Figure 5A:
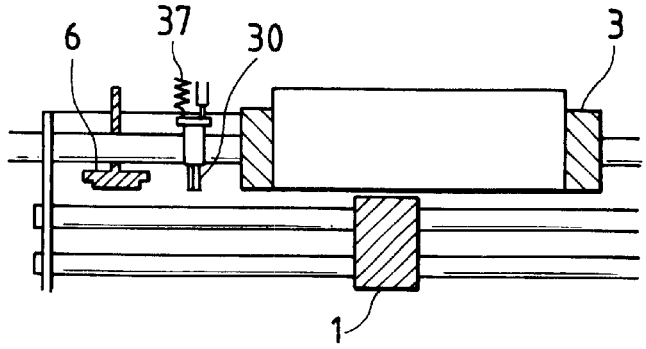
FIGS. 5*a* to 5*d* and 6*a* to 6*d* are explanatory diagrams showing operations of a recording head and a cleaning unit according to the first cleaning method, respectively.
Figure 5B:
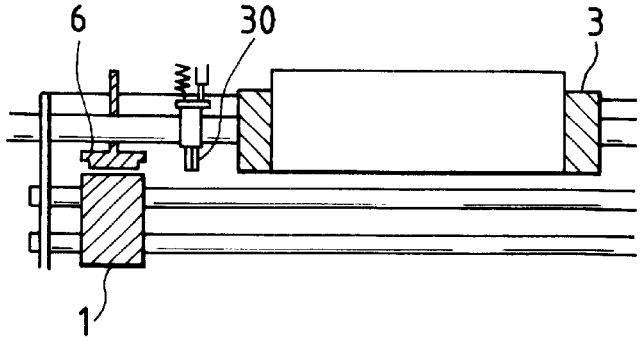
Figure 5C:
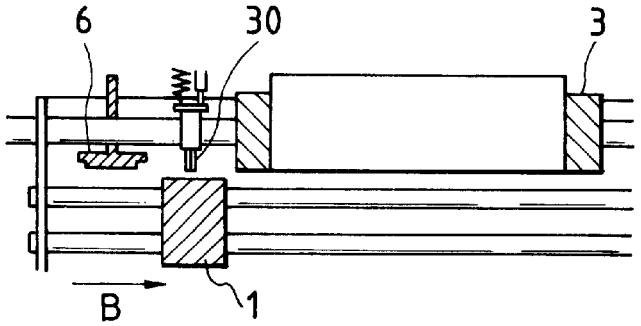
Figure 5D:
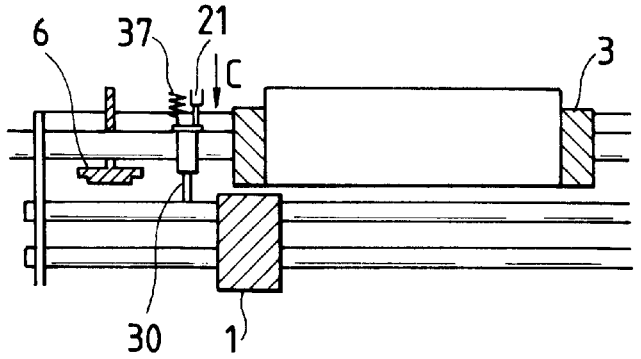
Figure 6A:
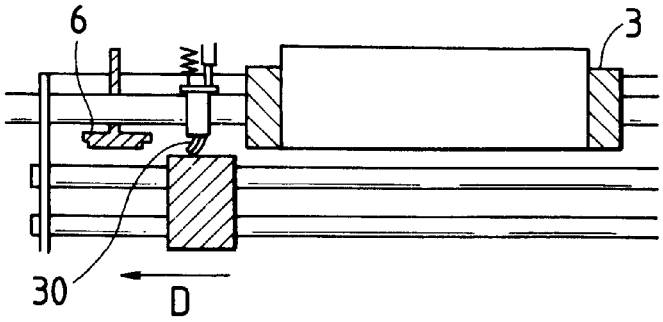
Figure 7A:
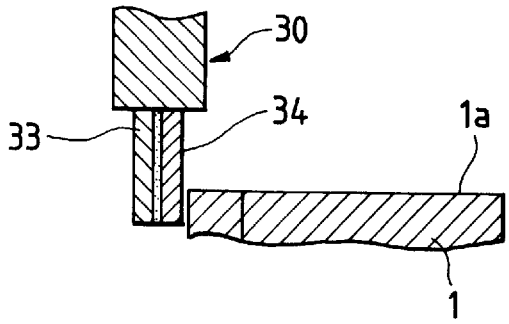
FIGS. 7*a*, 7*b*, 8*a* and 8*b* are enlarged diagrams showing a cleaning element according to a modified embodiment of the present invention.
Figure 7B:
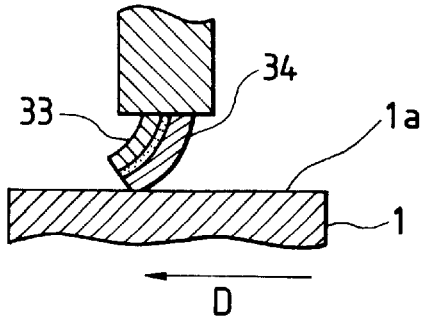

When, during printing, the printing quality is lowered, the recording head 1 (FIG. 5*a*) is returned from the printing region to its home position; i.e., its standby position (Step 60 in FIG. 4), where the nozzle surface 1*a* of the recording head 1 is sealed with the capping unit 6. when, under this condition, the suction pump 23 is operated with the valve 25 closed, negative pressure is applied to the nozzles so that ink is discharged from the nozzles into the capping space (Step 61 in FIG. 4, and FIG. 5*b*); that is, an ink discharge restoring operation is carried out. Thereafter, the capping unit 6 is disconnected from the recording head 1, and then the latter 1 is moved towards the printing region, as indicated at the arrow B in FIG. 5*c* (Step 62 in FIG. 4). When the nozzle openings of the recording head 1 are confronted with the rubbing member 34 of the cleaning element 30 (Step 63 in FIG. 4, and FIG. 5*c*), the flushing means is operated to cause the recording head 1 to discharge ink through the nozzles (step 64 in FIG. 4). As a result, the rubbing member 34 of the cleaning unit 5 is wetted with the ink thus discharged. When the recording head 1 has passed through the cleaning element 30 (Step 65 in FIG. 4), the electromagnetic plunger 21 is excited to cause the end face of the cleaning element 30 to go in the direction of the arrow C in FIG. 5 across the path of movement of the nozzle surface (Step 66 in FIG. 4, and FIG. 5*d*). Thereafter, the recording head 1 is moved in the opposite direction, towards the capping unit 6 (Step 67 in FIG. 4) until the nozzle surface 1*a* of the recording head 1 is brought into contact with the cleaning element 30. When, under this condition, the recording head 1 is further moved, the cleaning element 30 is pushed against the side of the recording head 1, so that the cleaning element 30 is elastically deformed in such a manner that the end portion is bent towards the capping unit 6, being laid over the recording head 1. Thus, only the rubbing member 34 comes into contact with the nozzle surface 1*a* of the recording head 1 (FIG. 7*a*). When, under this condition, the recording head 1 is further moved towards the capping unit 6 (in the direction of the arrow D in FIG. 7*b*), only the rubbing member 34 wetted with ink is brought into contact with the nozzle surface 1*a* of the recording nozzle. When, under this condition, the recording head 1 is moved towards the capping unit 6, the rubbing member 34 wetted with ink rubs the nozzle openings (FIG. 6*a*, and FIG. 7*b*), thus removing solidified ink or dust therefrom. In this rubbing operation, as is seen from FIG. 7*b*, the rubbing member 34 is elastically deformed with the aid of the silicon rubber blade 33, so that only its end portion is brought into contact with the nozzle openings to wipe off the ink solution and the solidified ink.

Figure 6B:
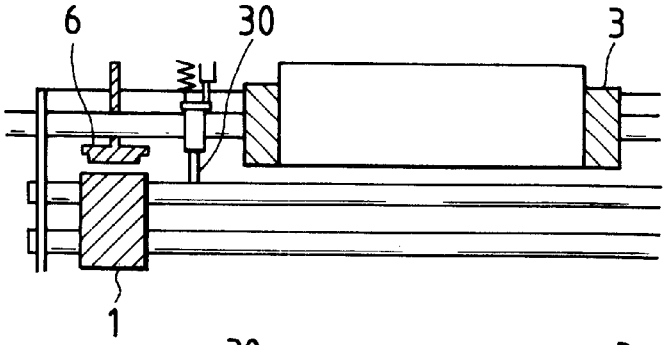
Figure 6C:
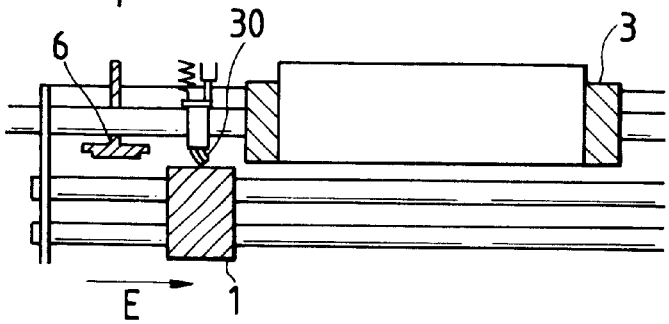
Figure 8A:
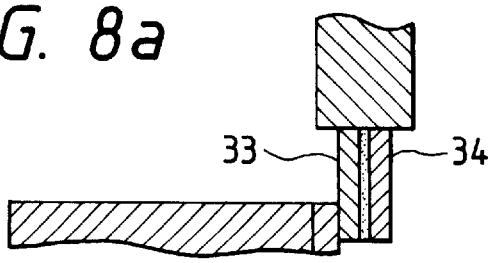
Figure 8B:
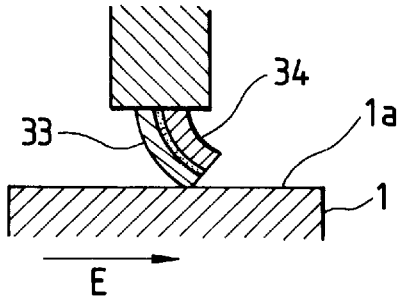

In the case where, although the recording head 1 has passed through the cleaning unit 5 (FIG. 6*b*), the wiping operation should be carried out again (Step 68 in FIG. 4), the carriage 4 is moved in the opposite direction to move the recording head 1 towards the printing region. As a result, the recording head 1 is abutted against the cleaning element 30 (FIG. 5*a*), so that the end portion of the latter 30 is elastically bent towards the printing region. That is, the edge of the blade member 33 is brought into contact with the nozzle surface, thus removing a thin layer of ink therefrom which has not been removed (FIG. 6*c*, and FIG. 8*b*).

Figure 6D:
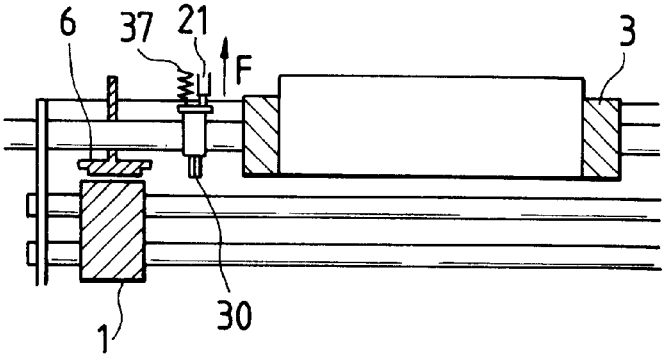

In the case where the printing operation has been suspended to clean the nozzle surface, after the nozzle surface has been cleaned up in the above-described manner the electromagnetic plunger 21 is deenergized to retract the cleaning element 30 from the path of movement of the nozzle in the direction of the arrow F in FIG. 6*d*, and then the recording head is moved to the printing region, to resume the printing operation. In the case where the cleaning operation has been carried out with the apparatus at rest, the electromagnetic plunger 21 is deenergized so that the end portion of the cleaning element 30 in retracted from the path of movement of the recording head, and then the carriage 4 is moved in the opposite direction to move the recording head 1 to the capping unit 6, so that recording head 1 is sealed by the latter 6 (FIG. 6*d*).

In the cleaning element 30, the elastic blade member 33 is set on the side of the capping unit, and the rubbing member 34 of flexible unwoven cloth is on the side of the printing region. Therefore, the wiping operation which is more frequently carried out than the rubbing operation when the apparatus is at rest or after the ink discharge restoring operation, can be achieved merely by moving the recording head 1 to the printing region with the plunger 21 energized. That is, the movement of the recording head 1 to the printing region can be utilized for the cleaning operation. After the recording head 1 has passed through the cleaning element 30, the latter 30 is elastically restored by its own elasticity to the original position. In this operation, the blade member 33 is elastically bent towards the capping unit, so that the solidified ink and dust stuck to the nozzle surface during cleaning are thrown towards the capping unit 6; that is, the recording sheet is prevented from being contaminated thereby.

In the above-described embodiment, before the cleaning operation starts, ink is flushed from the nozzles to wet the cleaning element 30. However, when it is immediately after the ink discharge restoring operation, this flushing operation may be omitted.

Figure 9:
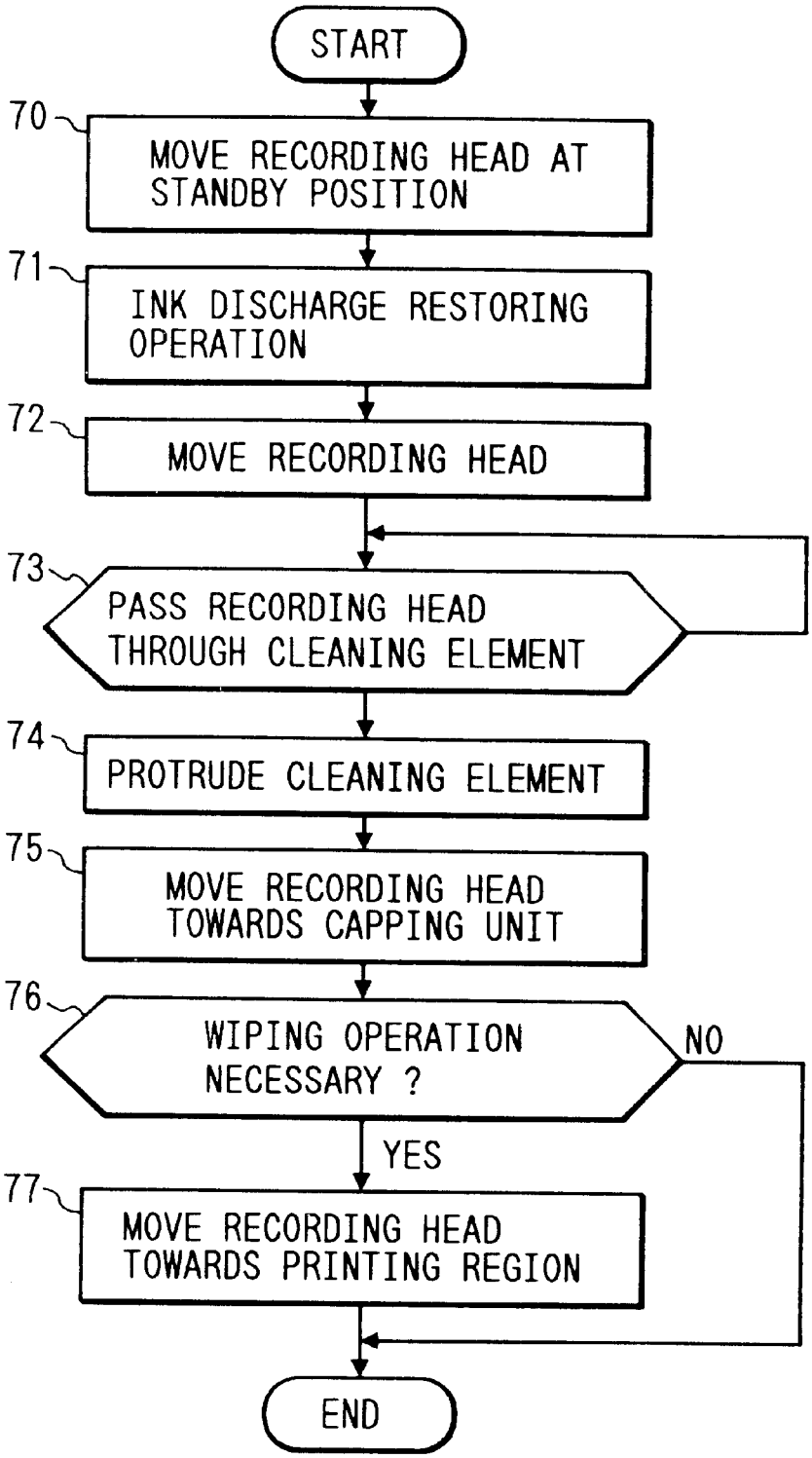
FIG. 9 is a flow chart showing a second cleaning method in an ink jet type recording apparatus according to the present invention.
Figure 10A:
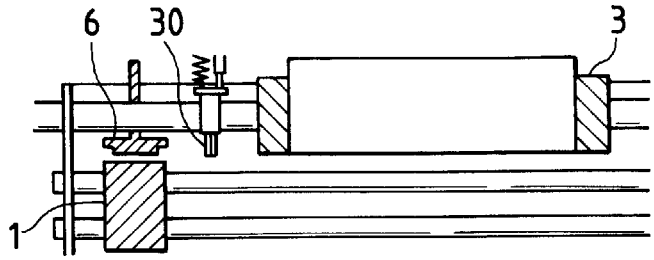
FIGS. 10*a* through 10*d* are explanatory diagrams showing an operation of a cleaning unit according to the present invention, respectively.
Figure 10B:
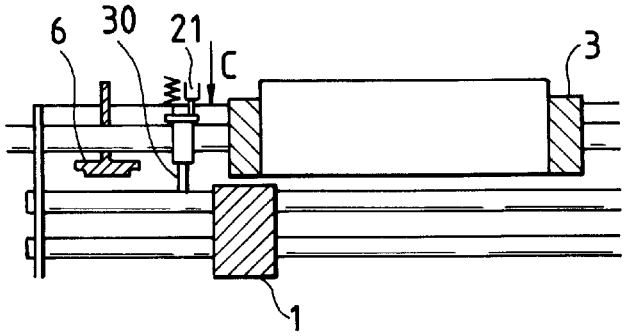
Figure 10C:
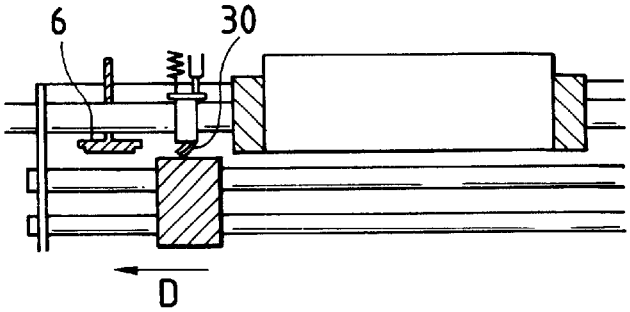

That is, the recording head 1 is moved to the standby position (Step 70 in FIG. 9), where the nozzle surface 1*a* of the recording head 1 is sealed with the capping unit 6. Under this condition, the suction pump 23 is operated to forcibly suck out ink; that is, the ink discharge restoring operation is carried out (FIG. 10*a*). Normally, after the suction of ink, the valve 25 is opened so that the capping unit 6 is opened to the air, and then the pump 23 is operated again so as to remove the ink splashed onto the nozzle surface 1*a* during the suction of ink; that is, a false suction is carried out. However, with this false suction omitted, the capping unit 6 is disengaged from the nozzle surface, and the recording head 1 is moved to the printing region. And when the recording head has passed through the cleaning element 30 (Step 73 of FIG. 9), the electromagnetic plunger 21 is energized to jerk the cleaning element 30 into the path of movement of the nozzle opening 1*a* (FIG. 10*b*). Thereafter, the recording head 1 is moved in the opposite direction, towards the capping unit 6 in the direction of the arrow D in FIG. 10*c* (Step 75 in FIG. 9), so that the rubbing member 34 is elastically brought into contact with the nozzle surface 1*a*.

In the case of the ink discharge restoring operation in which the false suction is not carried out, ink remains on the nozzle surface 1*a* of the recording head 1. The ink is absorbed by the rubbing member 34; that is, the latter 34 is wetted with the ink. When, under this condition, the recording head 1 is moved towards the capping unit 6, similarly as in the above-described case the wet rubbing member 34 rubs the nozzle surface 1*a* to wipe off ink, dust and fibers coming out of the recording medium from the nozzle surface 1*a*.

Figure 10D:
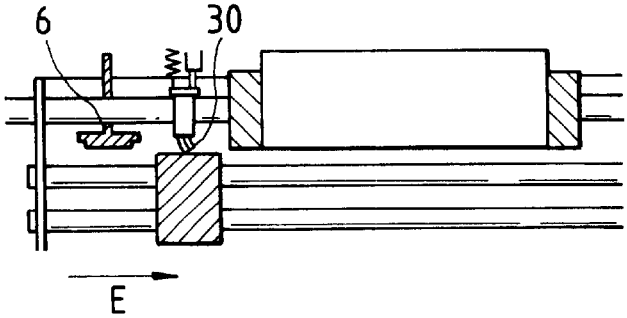

When it is required to perform the wiping operation again (Step 76 in FIG. 9), the recording head 1 is moved in the opposite direction, towards the recording region. In this operation, similarly as in the above-described case the blade member 33 is brought into contact with the nozzle surface, to scrape the layer of ink off the latter (Step 77 in FIG. 9, and FIG. 10*d*).

In the above-described cleaning method, it is unnecessary to perform a flushing operation for the cleaning element 30, and therefore the difficulty that ink is splashed when flushed is eliminated. That is, the inside of the printer housing is prevented from being made dirty with ink.

A case where a cleaning operation is selected as the need arises will be described with reference to FIGS. 11, 12, 13 and 14.

In a cleaning operation, the rubbing operation made by the rubbing member 34 is not always necessary, that is, there is a case where the wiping operation is sufficient to remove contaminators from a recording head. In this case, only the wiping operation is performed. On the contrary, if one wiping operation was insufficient to remove contaminators from the recording head, further the rubbing operation is performed. Instead, initially one rubbing operation is performed, and if the contaminators have not yet been removed from the recording head, the rubbing operation may be repeated several times, for example, five times.

A timing control means 20 will be described with reference to FIG. 11.

Figure 11:
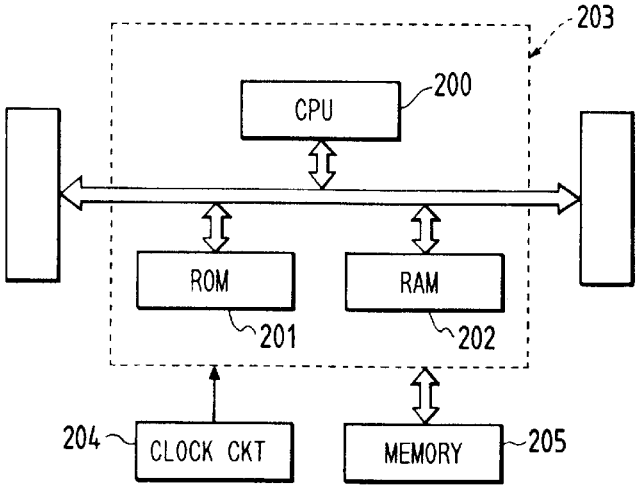
FIGS. 11 and 13 are block diagrams showing a timing control means to be realized by a microcomputer, respectively.

The timing control means 20, as shown in FIG. 11, is composed of a microcomputer 203 including a CPU 200, a ROM 201 and a RAM 202, a clock circuit 204 and a memory 205 for storing a time when a cleaning instruction button, which is provided on the operating panel of an ink jet type recording apparatus body, is pushed. When the cleaning instruction button is pushed, a position detector 304 (FIG. 12) produces a signal. At this time, the timing control means 20 outputs a signal to the solenoid drive means 22 (FIG. 2) to energize the electromagnetic plunger 21 so that the cleaning unit 5 is moved towards the recording head 1. The timing control means 20 also outputs a signal to the carriage driving means 28 to perform a cleaning operation which has been previously programmed.

Figure 12:
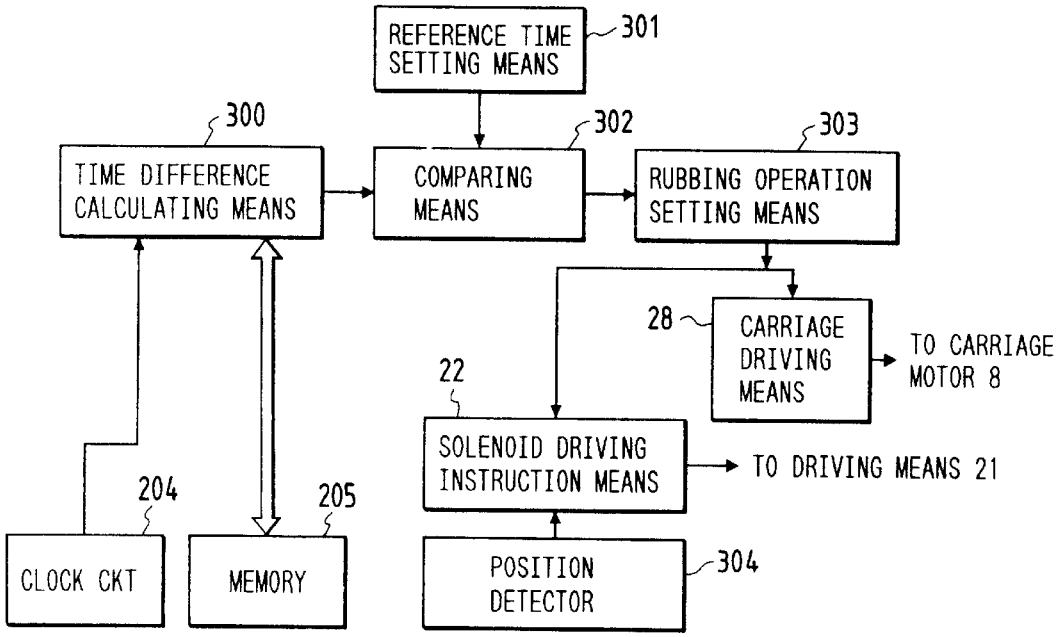
FIGS. 12 and 14 are block diagrams illustrative of the function of a microcomputer constituting the timing control means of FIGS. 11 and 13, respectively.

FIG. 12 is a block diagram illustrating a model of the function to be realized by the microcomputer 203 of FIG. 11. The circuit shown in FIG. 12 is constituted by a time difference calculation means 300 for calculating a time difference ΔT between a time data when previously pushing the cleaning instruction button and a time when pushing the cleaning instruction button at present, a reference time setting means 301 for setting and storing a reference time $T_0$ to judge a type of printing defect, a comparing means 302 for comparing the time difference data ΔT output from the time difference calculation means 300 with the reference time $T_0$ stored in the reference time setting means 301. The circuit also includes a rubbing operation setting means 303, a solenoid driving means 22 and a carriage driving means 28 to control, on the basis of the result of the comparison, the operation of the rubbing member 34 enough to remove solidified ink, dust, fibers, etc. from the nozzle surface of the recording head.

In this embodiment, a cleaning operation is selected on the basis of a time difference when pushing the cleaning instruction button. The same effect can be also obtained by controlling an ink auction time or ink auction quantity due to the capping unit 6 in response to a printing quantity or a paper feed quantity.

This embodiment will be described with reference to FIG. 13.

Figure 13:
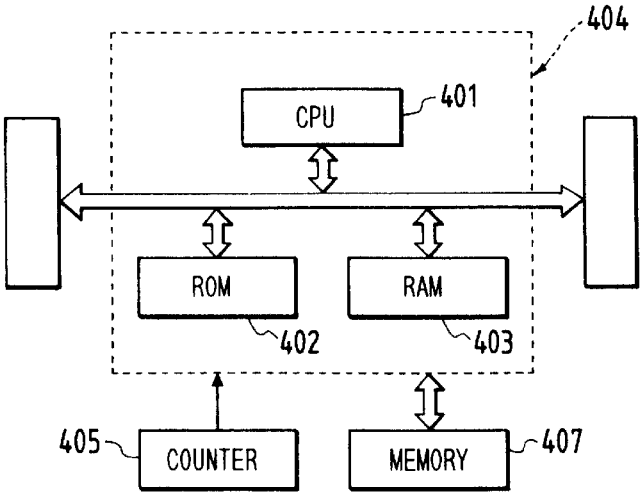

FIG. 13 is a block diagram showing a timing control means 20 which is constituted by a microcomputer 404 including a CPU 401, a ROM 402 and a RAM 403, a counter 405 for counting an integrating print quantity such as the number of printed characters, the number of lines, and the amount of paper food, and a memory 407 for storing data of the integrating print quantity from the counter 405 when a cleaning instruction button, which is provided on the operating panel of an ink jet type recording apparatus body, is pushed. When a cleaning operation instruction button is pushed, a position detector 304 (FIG. 14) produces a signal. At this time, the timing control means 20 outputs a signal to a solenoid driving means 22 (FIG. 2) to energize an electromagnetic plunger 21 so that the cleaning unit 5 is moved towards the recording head 1. Also, the timing control means 20 outputs a signal to a carriage driving means 28 to perform a cleaning operation previously programmed.

Figure 14:
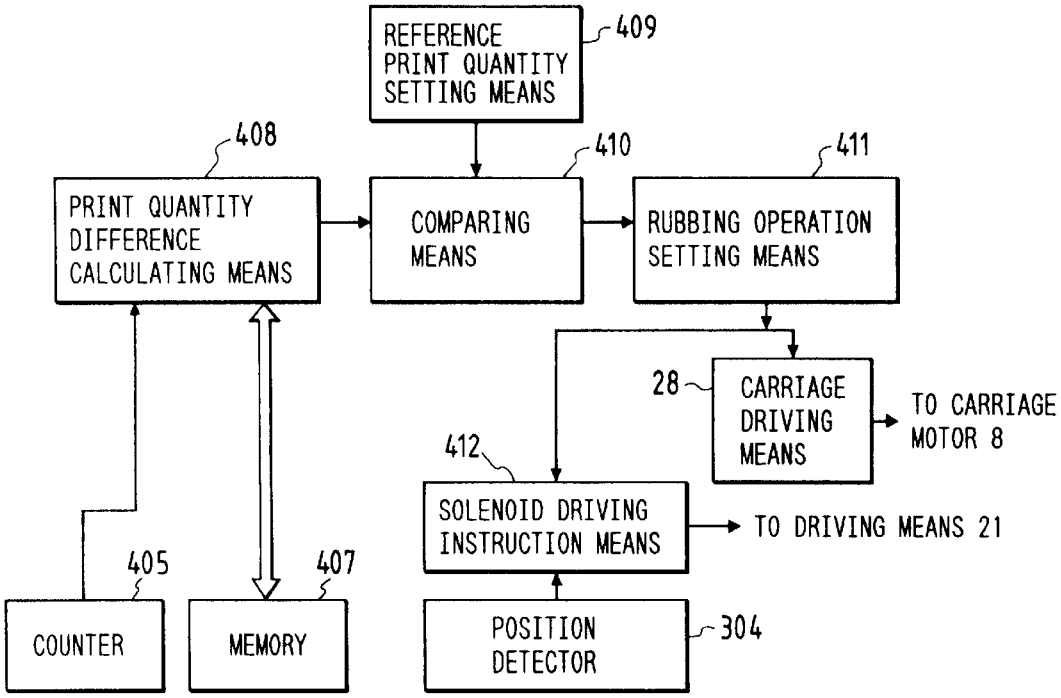

FIG. 14 is a block diagram showing a model of the function to be realized by the microcomputer 404 of FIG. 13. The circuit shown in FIG. 14 is composed of a print quantity difference calculation means 408 for calculating a print quantity difference ΔL between print quantity data stored in the memory 407 and data in the counter 405 when the cleaning instruction button is pushed, a reference print quantity setting means 409 for setting and storing a reference print quantity $L_0$ to judge a type of printing defect, a comparing means 410 for comparing data of the print quantity difference sent from the print quantity difference calculation means 408 with the reference print quantity $L_0$ from the reference print quantity setting means 409. The circuit is also composed of a rubbing operation setting means 303, a solenoid driving means 22 and a carriage driving means 28 to control, on the basis of the result of the comparison, the operation of the rubbing member 34 enough to remove solidified ink, dust, fibers, etc. from the nozzle surface of the recording head.

Figure 15:
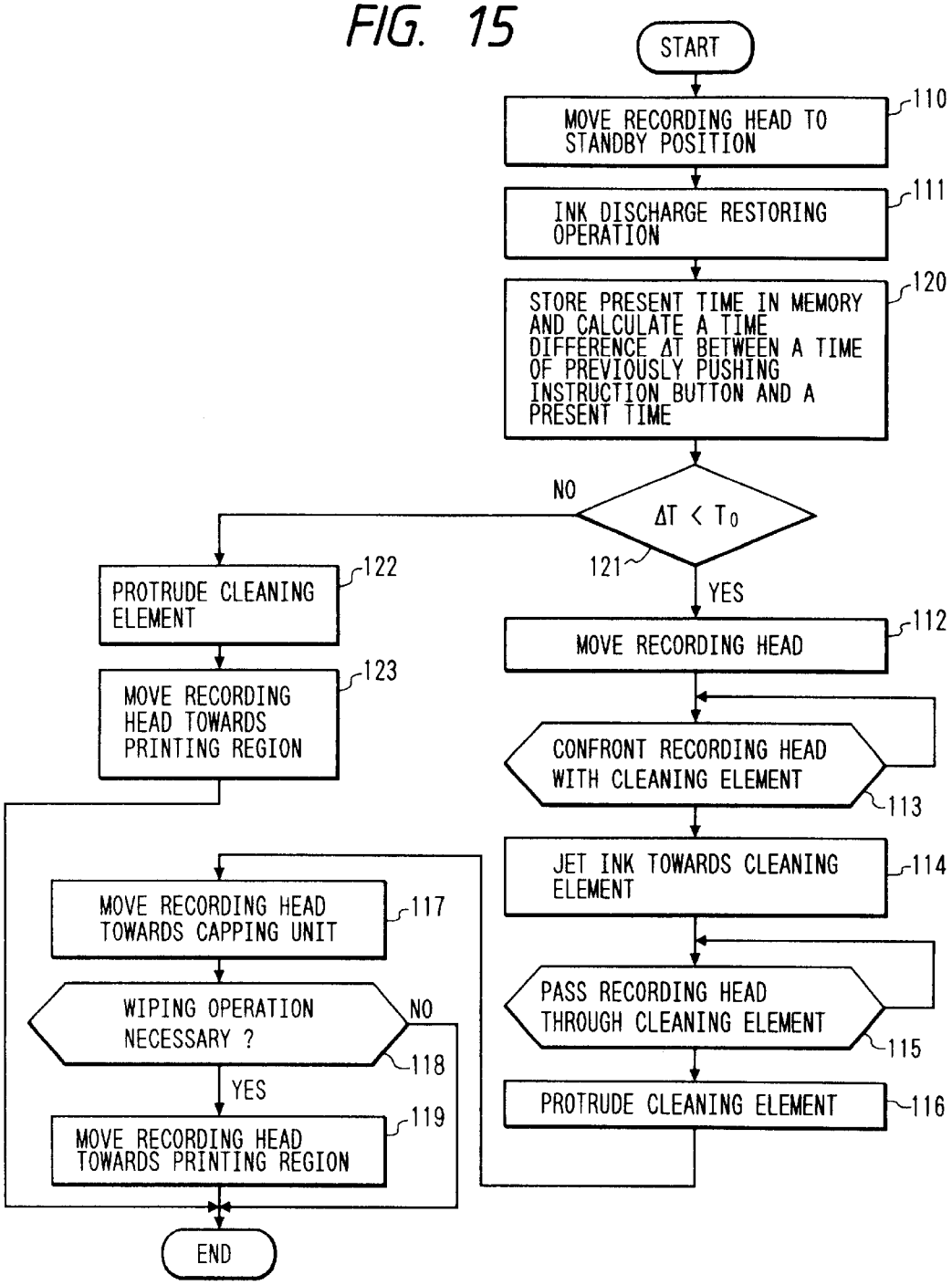
FIGS. 15 and 16 are flow charts showing the operation of the timing control means of FIGS. 11 and 13, respectively.
Figure 16:
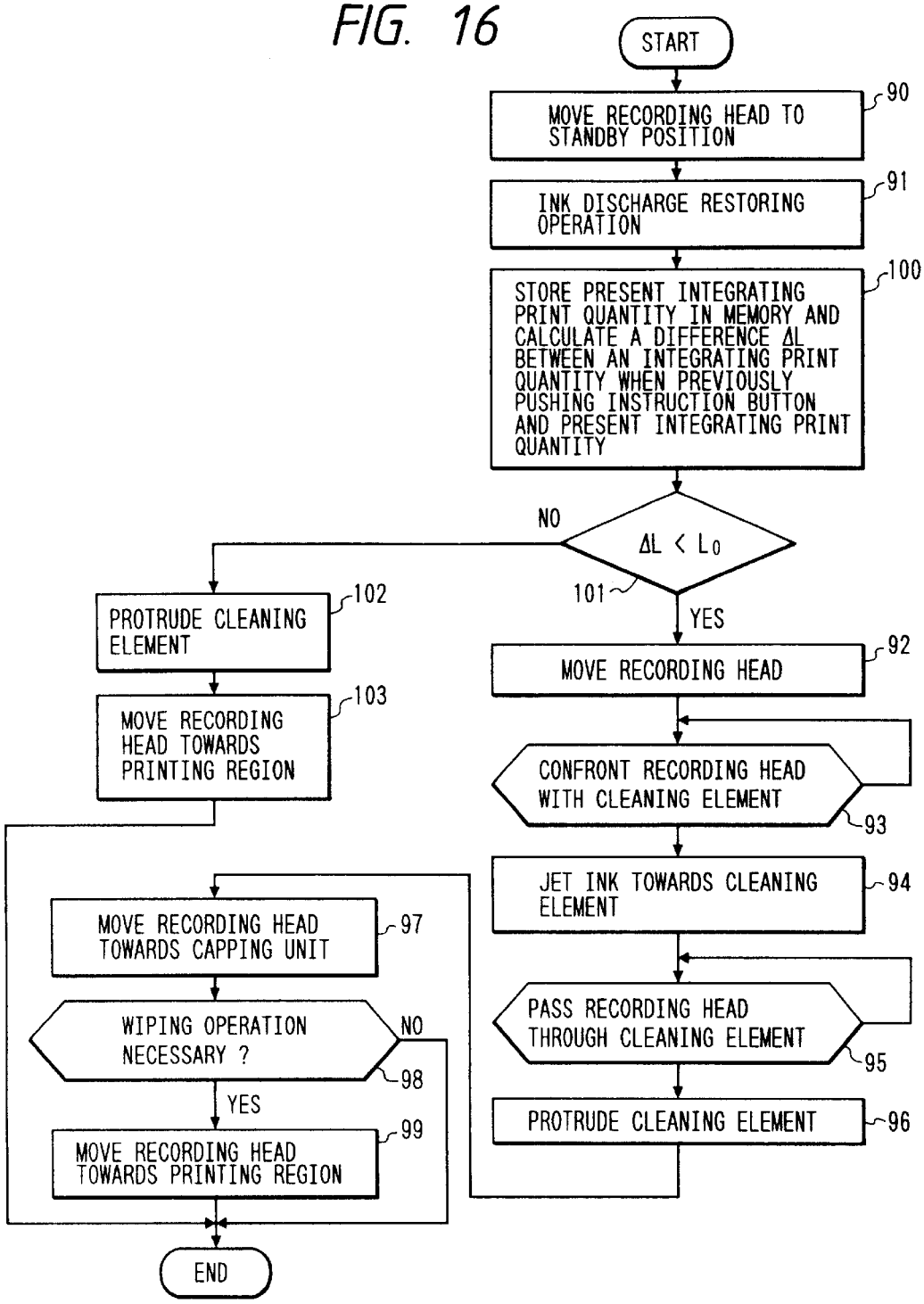

The operation of the apparatus thus arranged will be then described with respect to FIGS. 15 and 16.

Figure 4:
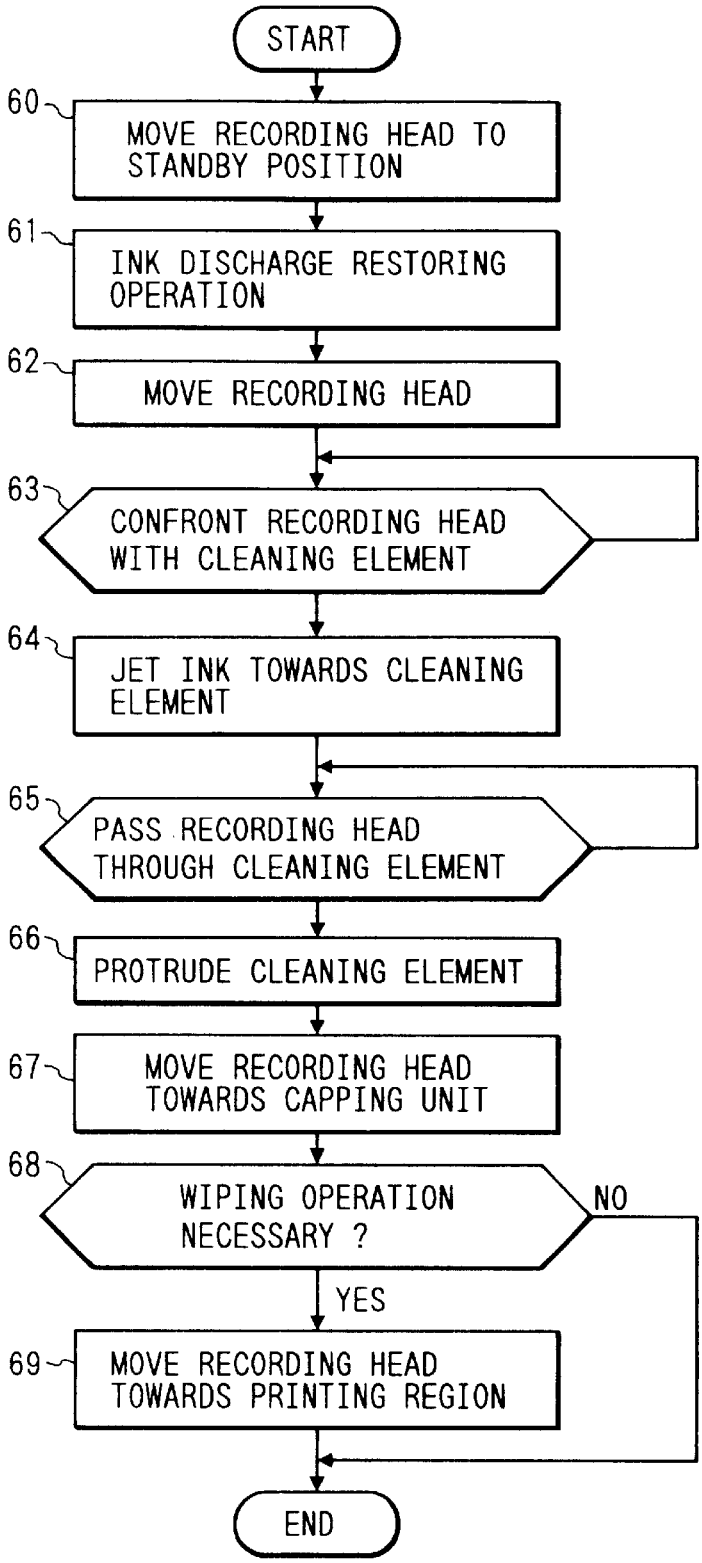
FIG. 4 is a flow chart showing a first cleaning method in an ink jet type recording apparatus according to the present invention.

In FIG. 15, Steps 110 through 119 correspond to Steps 60 through 69 in FIG. 4, and their description will be omitted here. After performing the ink discharge restoring operation (Step 111 in FIG. 15), a time difference ΔT between a time when previously pushing the cleaning instruction button and the present time is calculated (Step 120). Then, the time difference ΔT thus calculated is compared with the predetermined reference time $T_0$, and as a result of the comparison, if ΔT is smaller than $T_0$, then it is judged that contaminators have not been sufficiently removed from the recording head by the previous cleaning operation (Step 121). In this case, the operation of Steps 112 through 119 is performed. On the other hand, if ΔT is not smaller than $T_0$, then it is judged that contaminators have been sufficiently removed from the recording head by the previous cleaning operation, and only the wiping operation is carried out as a first cleaning operation (Steps 122 and 123).

In the cleaning method of FIG. 15, a cleaning operation is selected on the basis of a time difference between a time when performing the previous cleaning operation and the present time. However, a cleaning operation may be selected on the basis of a difference between an integrating print quantity at the time of the previous cleaning operation and the present integrating print quantity. This embodiment will be described with respect to FIG. 16.

In FIG. 16, Steps 90 through 99 correspond to Steps 60 through 69 of FIG. 4, and therefore their description will be omitted. After the discharge restoring operation (Step 91 in FIG. 16), a difference ΔL between an integrating print quantity when previously pushing a cleaning instruction button and the present integrating print quantity is calculated (Step 100). Then, the difference ΔL thus calculated is compared with a predetermined reference print quantity $L_0$, as a result of which if ΔL is smaller than $L_0$, then it is judged that contaminators have been insufficiently removed from the recording head by the previous cleaning operation (Step 101). In this case, the operation of Steps 92 through 99 is performed. On the other hand, it ΔL is not smaller than $L_0$, then it is judged that contaminators have been sufficiently removed from the recording head by the previous cleaning operation, and then only the wiping operation is carried out as a first cleaning operation. (Steps. 102 and 103).

In the cleaning operation described above, if contaminators have not yet been removed from the recording head by the first cleaning operation, the cleaning instruction button is pushed again after printing to perform the cleaning operation shown in FIG. 15 or 16. At this time, a specific cleaning method may be set, for example, the operation of Steps 112 to 117 or Steps 92 to 97 is repeated several times such as five times. Also, in the second cleaning operation, the times of allowing the recording head to abut against the blade may be set to a plurality of times.

Figure 17A:
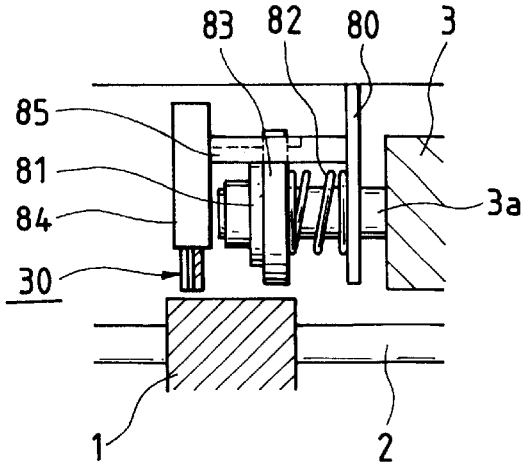
FIG. 17*a* is a front view showing a drive means used in an ink jet type recording device according to a second embodiment of the present invention.
Figure 17B:
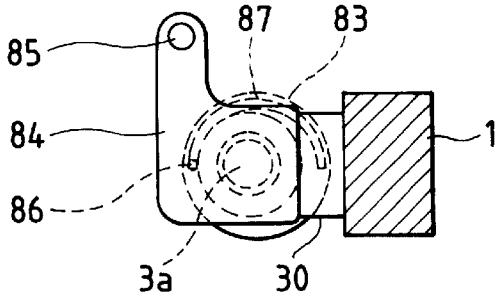
FIGS. 17*b* and 17*c* are side views showing the operation of a drive means shown in FIG. 11*a*, respectively.
Figure 17C:
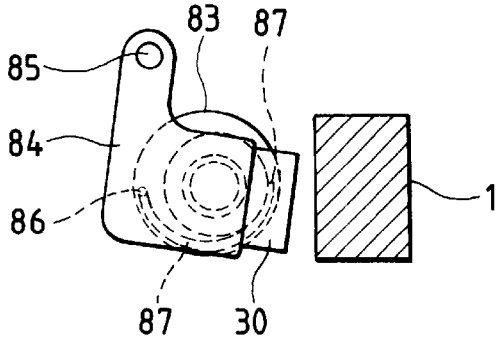

FIGS. 17*a* through 17*c* show another example of the cleaning unit. The cleaning unit is moved by the torque of the platen 3.

The rotary shaft 3*a* of the platen 3 is supported by an intermediate frame 80. A frictional disk 81 is fixedly mounted on the end portion of the rotary shaft 3*a* thus supported. A compression spring 92 and a cleaner opening and closing plate 83 are arranged between the intermediate frame 80 and the frictional disk 81 in such a manner that the plate 83 is pushed against the frictional disk by the compression spring 82. Hence, the plate 83 is turned in synchronization with the rotation of the platen 3, and when regulated by a rotation regulating member, it is allowed to slide on the frictional disk 81.

In FIGS. 17*a* through 17*c*, reference numeral 30 designates the above-described cleaning element. The cleaning element 30, as shown in FIG. 17*b*, is rotatably supported through a supporting member 84 on a shaft 85 which is fixedly secured to the intermediate frame 80. A pin 86 embedded in the supporting member 84 is engaged with an arcuate groove 87 which is formed in the cleaner opening and closing plate 83 in such a manner that its radius is increased with the displacement of the platen 3 in the sheet feeding direction.

When the cleaner opening and closing plate 83 is operated in association with the rotation of the platen 3, the supporting member 84 is turned about the shaft 85, so that, as shown in FIG. 17*c*, the cleaning element 30 is retracted to the position where it is not brought into contact with the nozzle surface 1*a* of the recording head 1. Even when, under this condition, the platen 3 is further turned in the sheet feeding direction, the cleaning element is not displaced because the cleaner opening and closing plate 83 is allowed to slide on the frictional disk 81.

When, under this condition, the platen 3 is turned in the opposite direction (in the direction opposite to the sheet feeding direction), the cleaning element 30 is moved as shown in FIG. 17*b*. With the cleaning unit thus constructed, even it, in the case where the cleaning element 30 is protruded after the recording head 1 has been moved to the position where it is confronted with the cleaning element 30, it is tried to push the cleaning element 30 against the nozzle surface 1*a* with a load higher than a certain value, the cleaning element 30 will slide. Hence, even when the position of the recording head 1 with respect to the platen 3 is adjusted by moving it back and forth according to the thickness of a recording medium, the cleaning element 30 can be brought into contact with the recording head 1 under a predetermined pressure.

In the above-described cleaning unit, it is unnecessary to use drive means such as an electromagnetic plunger, and the power of the motor 10 for driving the platen 3 can be utilized. Hence, the cleaning unit is simple in construction.

The cleaning operation has been described which is carried out when the recording apparatus is in use. However, it goes without saying that the above-described method can be used for cleaning an new ink jet typo recording apparatus which has been just procured.

In general, until an ink jet type recording apparatus is delivered from the factory to a user, the recording head is held filled with a solution called "shipping solution" so as to allow the wall of the ink flowing path to have affinity or attraction for ink, thus being maintained unchanged in quality. The shipping solution, being different from ink, is lower in volatility and higher in viscosity than ink. Hence, it is essential to completely remove the shipping solution from the nozzle surface when the recording apparatus is used for the first time; otherwise the resultant print would be unsatisfactory in picture quality. In this case, the use of the rubbing member of the cleaning element is markedly effective in removal of the shipping solution.

What is claimed is:

1. A device for cleaning a recording head of an ink jet type recording apparatus, comprising:

a plate movably coupled to a motor of the recording apparatus such that said plate rotates in accordance with rotational movement of the motor;

a cleaning part disposed on a supporting member which secures the cleaning part to the recording apparatus, said supporting member being movably coupled to said plate; and a mechanism frictionally coupled to said plate to selectively transmit rotational movement of said motor to said plate, such that rotational movement of said plate is translated into lateral movement of said supporting member causing said supporting member to move between a position where said cleaning part abuts against the recording head and a position where said cleaning part is spaced from the recording head wherein said rotational movement of said motor is not transmitted to said plate when said cleaning part is in said position where said cleaning part abuts against the recording head.

2. A cleaning device as claimed in claim 1, wherein one of said support member and said plate includes a pin, and another of said support member and said plate includes an arcuate opening which engages with said pin to convert said rotational movement of said plate into reciprocating movement of said supporting member.

3. A cleaning device as claimed in claim 1, wherein said cleaning part comprises an elastic blade member and a water-absorbing rubbing member bonded to said blade member.

4. A cleaning device as claimed in claim 1, further comprising a platen having a platen rotary shaft supporting said plate, wherein said mechanism is integrally disposed on said platen rotary shaft, said mechanism frictionally coupling said platen rotary shaft and said plate.

5. A cleaning device as claimed in claim 4, wherein one of said support member and said plate includes a pin, and another of said support member and said plate includes an arcuate opening which engages with said pin to convert said rotational movement of said plate into reciprocating movement of said supporting member, such that said supporting member retracts said cleaning part from said recording head when said platen rotates in a feed direction and contacts said cleaning part with said recording head when said platen rotates oppositely to said feed direction.

6. A device for cleaning a recording head of an ink jet type recording apparatus, comprising:

a frame;

a supporting member having a cleaning element, said supporting member being moveably supported to said frame so that said cleaning element is movable between a first position where said cleaning element is contactable with the recording head and a second position where said cleaning element is kept away from the recording head; and an excess rotation absorbing system through which a motor is coupled to said supporting member, wherein said excess rotation absorbing system keeps said cleaning element in said first position when said motor is rotated in a first direction, and in said second position when said motor is rotated in a first direction, and in said second position when said motor is rotated in a second direction opposite from the first direction.

7. A device for cleaning a recording head of an ink jet type recording apparatus, comprising:

a frame;

a supporting member having a cleaning element, said supporting member being movably supported to said frame so that said cleaning element is movable between a first position where said cleaning element is contactable with the recording head and a second position where said cleaning element is kept away from the recording head; and a motion converting system through which a motor is coupled to said supporting member, wherein said motion converting system converts rotational motion of the motor into movement of the cleaning element until the cleaning element reaches one of the first and second positions from the other, and inhibits the rotational motion of the motor from being converted into the movement of the cleaning element after the cleaning element reaches the one of the first and second positions.

* * * * *